US009875827B2

(12) United States Patent
Yoshinaga et al.

(10) Patent No.: US 9,875,827 B2
(45) Date of Patent: Jan. 23, 2018

(54) METHOD FOR PRODUCING INSULATED ELECTRIC WIRE

(71) Applicant: Yazaki Corporation, Minato-ku, Tokyo (JP)

(72) Inventors: Satoru Yoshinaga, Susono (JP); Satoshi Yamano, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 220 days.

(21) Appl. No.: 14/404,731

(22) PCT Filed: May 31, 2013

(86) PCT No.: PCT/JP2013/065765
§ 371 (c)(1),
(2) Date: Dec. 1, 2014

(87) PCT Pub. No.: WO2013/180312
PCT Pub. Date: Dec. 5, 2013

(65) Prior Publication Data

US 2015/0113800 A1 Apr. 30, 2015

(30) Foreign Application Priority Data

Jun. 1, 2012 (JP) ..... 2012-125939

(51) Int. Cl.
*H01R 43/00* (2006.01)
*H01B 13/00* (2006.01)
(Continued)

(52) U.S. Cl.
CPC ..... *H01B 13/0036* (2013.01); *C22C 9/02* (2013.01); *C22F 1/08* (2013.01); *H01B 1/026* (2013.01);
(Continued)

(58) Field of Classification Search
CPC ..... Y10T 29/49117; C22C 9/02; H01B 13/06
(Continued)

(56) References Cited

U.S. PATENT DOCUMENTS 5,149,917 A 9/1992 Sawada et al.
8,101,285 B2 1/2012 Mitose et al.
(Continued)

FOREIGN PATENT DOCUMENTS

CN 1592938 A 3/2005
CN 1988055 A 6/2007
(Continued)

OTHER PUBLICATIONS

Communication dated Jan. 25, 2016, issued by the State Intellectual Property Office of P.R. China in counterpart Chinese Application No. 201380029039.X.
(Continued)

*Primary Examiner* — Thiem Phan
(74) *Attorney, Agent, or Firm* — Sughrue Mion, PLLC

(57) ABSTRACT

A method for producing an insulated electric wire comprises a first step of processing a copper alloy containing a tin and inevitable impurities into a fine wire having a diameter of 0.21 mm±0.008 mm, the tin being 0.30 wt % or more and 0.39 wt % or less, a second step of annealing the fine wire obtained in the first step so as to refine the fine wire to have an extension coefficient of 10% or more and 25% or less and a tensile strength of 300 MPa or more and 400 MPa or less, and a third step of twisting the seven fine wires having undergone the second step with a twist pitch of 15 mm±6 mm.

2 Claims, 4 Drawing Sheets

(51) Int. Cl.

| | |
|---|---|
| ***C22C 9/02*** | (2006.01) |
| ***C22F 1/08*** | (2006.01) |
| ***H01B 1/02*** | (2006.01) |
| ***H01B 3/44*** | (2006.01) |
| ***H01B 13/06*** | (2006.01) |

(52) U.S. Cl.
CPC ..... *H01B 3/448* (2013.01); *H01B 13/06* (2013.01); *Y10T 29/49117* (2015.01)

(58) Field of Classification Search
USPC ..... 29/825, 428, 527.1; 148/432, 554; 174/36, 102 R, 126.1, 126.2
See application file for complete search history.

(56) References Cited

U.S. PATENT DOCUMENTS

| | | | | |
|---|---|---|---|---|
| 8,552,290 | B2 | 10/2013 | Debladis et al. | |
| 8,815,028 | B2 | 8/2014 | Takahashi et al. | |
| 2002/0066503 | A1* | 6/2002 | Matsui | C22F 1/08 148/432 |
| 2005/0029006 | A1 | 2/2005 | Takahashi et al. | |
| 2007/0187134 | A1 | 8/2007 | Detian et al. | |
| 2009/0229715 | A1 | 9/2009 | Takahashi et al. | |
| 2010/0252301 | A1 | 10/2010 | Debladis et al. | |
| 2011/0020664 | A1 | 1/2011 | Mitose et al. | |
| 2013/0092437 | A1 | 4/2013 | Yoshinaga | |
| 2014/0332124 | A1 | 11/2014 | Takahashi et al. | |

FOREIGN PATENT DOCUMENTS

| | | | |
|---|---|---|---|
| CN | 101535520 | A | 9/2009 |
| CN | 101728006 | A | 6/2010 |
| CN | 101981235 | A | 2/2011 |
| EP | 2 267 187 | A1 | 12/2010 |
| JP | 4-17214 | A | 1/1992 |
| JP | 2008-16284 | A | 1/2008 |
| JP | 2011-096505 | A | 5/2011 |
| WO | 2012/011611 | A2 | 1/2012 |

OTHER PUBLICATIONS

Communication from the Japanese Patent Office dated May 10, 2016 in a counterpart Japanese application No. 2012-125939.
Communication from the Japanese Patent Office dated Mar. 2, 2016 in a counterpart Japanese application No. 2012-125939.
Written Opinion dated Jul. 22, 2013 issued by the International Searching Authority in counterpart International Patent Application No. PCT/JP2013/065765 (PCT/ISA/237).
Search Report dated Jul. 22, 2013 issued by the International Searching Authority in counterpart International Patent Application No. PCT/JP2013/065765 (PCT/ISA/210).

* cited by examiner

Fig.6

| TERMINAL NO. | ANNEALED COPPER WIRE | | INSULATED WIRE ACCORDING TO EMBODIMENT | |
|---|---|---|---|---|
| | EARLY STAGE(N) | AFTER LONG TIME USE(N) | EARLY STAGE(N) | AFTER LONG TIME USE(N) |
| TERMINAL A | 39.5 ~ 47.5 | 33.0 ~ 40.0 | 60.5 ~ 76.6 | 63.1 ~ 74.6 |
| TERMINAL B | 52.1 ~ 58.2 | 46.3 ~ 52.2 | 67.86 ~ 74.70 | 72.98 ~ 77.42 |
| TERMINAL C | 56.4 ~ 59.2 | 52.0 ~ 56.2 | 62.1 ~ 73.8 | 68.9 ~ 75.4 |

METHOD FOR PRODUCING INSULATED ELECTRIC WIRE

TECHNICAL FIELD

The present invention relates to an insulated electric wire.

BACKGROUND ART

Recently, a wire known as a 0.3 sq wire having a conductor with a cross-sectional area of about 0.3 $mm^2$ has been proposed. Since this wire is made lightweight and is thin in diameter in comparison with a normal wire, the wire is used in a complicated circuit portion or used as automotive wire to contribute to the achievement of an improvement in fuel efficiency (for example, refer to PTL1 and PTL2).

Here, a conductor in which a thin copper alloy is subjected to work hardening by a fine wire process (plastic working by drawing with a die) to promote strength improvement is used in such a wire. The thin copper alloy refers to an alloy in which alloy elements are added to copper within the solid solubility limit thereof.

In addition, in recent years, in order to achieve a lighter weight and thinner diameter, a 0.22 sq wire having a smaller cross-sectional area of a conductor than that of the 0.3 sq wire has been proposed (refer to PTL2).

CITATION LIST

Patent Literature

[PTL1] JP-A-4-17214
[PTL2] JP-A-2008-16284

SUMMARY OF INVENTION

Technical Problem

However, when the thin copper alloy is used in the 0.22 sq wire, the copper alloy has a low strength as much as that of annealed copper by an annealing process (process of making metal soft by heat) after the fine wire process, and there is a problem in that standards required for the wire are not satisfied.

Specifically, it is necessary for the wire to have a terminal fixing force of 60 N or more in an early stage of terminal pressing or after a predetermined time elapses at a predetermined temperature according to the standards. However, when the strength of the conductor is lowered, the terminal fixing force of 60 N cannot be maintained due to the properties thereof, and the standards are not satisfied.

Solution to Problem

The invention is made to solve the problem in the related art and an object thereof is to provide an insulated electric wire capable of ensuring a terminal fixing force of 60 N or more and having a conductor with a cross-sectional area of about 0.22 $mm^2$.

A method for producing an insulated electric wire according to the invention includes a first step of processing a copper alloy containing a tin and inevitable impurities into a fine wire having a diameter of 0.21 mm±0.008 mm, the tin being 0.30 wt % or more and 0.39 wt % or less; a second step of annealing the fine wire obtained in the first step so as to refine the fine wire to have an extension coefficient of 10% or more and 25% or less and a tensile strength of 300 MPa or more and 400 MPa or less; and a third step of twisting the seven fine wires having undergone the second step with a twist pitch of 15 mm±6 mm.

In the method for producing an insulated electric wire according to the invention, since the fine wire is refined to have a tensile strength of 300 MPa or more in the second step, a terminal fixing force of 60 N or more can be ensured. That is, when the tensile strength is less than 300 MPa, the strength of the conductor is lowered, and hence, even in a case where the terminal is fixed, the lowering of the fixing strength thereof is caused so that a terminal fixing force of 60 N cannot be maintained. However, by refining the wire to have a tensile strength of 300 MPa or more in the second step, a terminal fixing force of 60 N or more can be ensured.

Moreover, since the wire is refined to have a tensile strength of 400 MPa or less in the second step, quality can be ensured as an insulated electric wire. That is, when the tensile strength is more than 400 MPa, an extension coefficient of 10% cannot be maintained any more. Therefore, the wire is poor in bending and cannot be produced as a product. However, by refining the wire to have a tensile strength of 400 MPa or less in the second step, an extension coefficient of 10% or more can be ensured and the quality of a product can be maintained.

The reason for using the copper alloy containing 0.30 wt % or more of tin is that when the content of tin is less than 0.30 wt %, a tensile strength of 300 MPa cannot be ensured and a terminal fixing force of 60 N cannot be maintained. Furthermore, the reason for using the copper alloy containing 0.39 wt % or less of tin is that when the content of tin is more than 0.39 wt %, conductivity is less than 72%, and a conductor resistance is more than 95 Ω/m so that the wire cannot be produced as a product.

In addition, it is preferable that the method according to the invention further comprises a fourth step of making a twisted wire obtained through the third step insulation-coated with a polyvinyl chloride resin composition having a smoking temperature of 170 degrees with a thickness of 0.27 mm or more and 0.35 mm or less, making the insulated electric wire to have a finishing outer diameter of 1.2 mm.

According to the method for producing an insulated electric wire, the polyvinyl chloride resin composition having a smoking temperature of 170 degrees is necessarily used as an insulator for a 0.22 sq wire, and has a thickness of 0.35 mm or less. In addition, when the finishing outer diameter is not 1.2 mm, the standards are not satisfied. Based on such a situation, when the thickness of the insulator is made 0.27 mm or more, a 7.5 A fuse is cut before the insulator emits smoke and deterioration due to the smoking of the wire itself can be prevented.

Advantageous Effects of Invention

According to the method for producing an insulated electric wire, a cross-sectional area of a conductor is made about 0.22 $mm^2$, and a terminal fixing force of 60 N or more can be ensured.

BRIEF DESCRIPTION OF DRAWINGS

FIG. 6 is a table showing a terminal fixing force of the insulated electric wire according to the embodiment.

DESCRIPTION OF EMBODIMENTS

Figure 1:
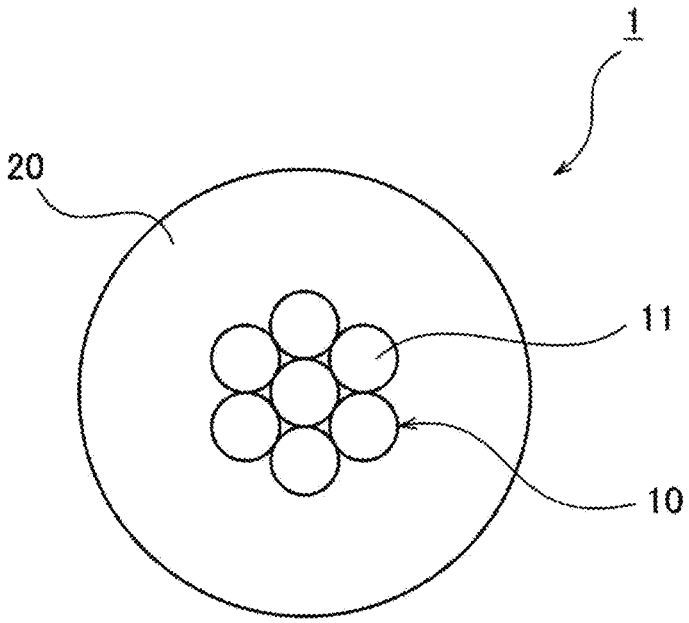
FIG. 1 is a cross-sectional view showing a configuration of a wire according to an embodiment of the invention.

Hereinafter, a preferred embodiment of the invention will be described referring to drawings. FIG. 1 is a cross-sectional view showing a configuration of a wire according to an embodiment of the invention. As shown in the same drawing, an insulated electric wire 1 includes a conductor 10 and an insulating layer 20 which covers the conductor 10.

In the embodiment, the conductor 10 is a twisted wire in which seven element wires 11 are twisted, and has a cross-sectional area of about 0.22 $mm^2$. The element wire 11 consists of a copper alloy containing tin, and is formed to have a diameter of 0.21 mm. The element wire 11 in the embodiment is a copper alloy containing tin and inevitable impurities.

The insulating layer 20 is formed by making the conductor 10 insulation-coated with a polyvinyl chloride resin composition having a smoking temperature of 170 degrees thereon with a thickness of 0.3 mm to have a finishing outer diameter of 1.2 mm.

The insulated electric wire 1 necessarily has a terminal fixing force of 60 N or more in an early stage of terminal pressing or after a predetermined time elapses according to standards. Thus, the inventors have found that the element wire 11 may have a tensile strength of 300 MPa or more in order to ensure a terminal fixing force of 60 N.

Figure 2:
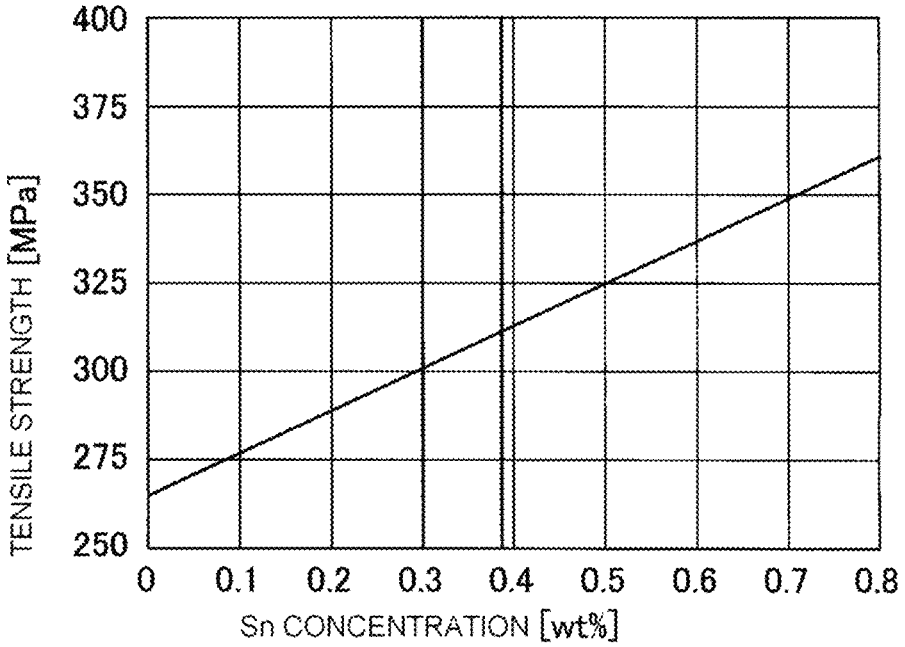
FIG. 2 is a graph showing a correlation between concentration of tin and tensile strength of an element wire after annealing.

As for the element wire 11 in the embodiment, a copper alloy containing 0.30 wt % or more of tin and inevitable impurities is employed. FIG. 2 is a graph showing a correlation between a concentration of tin and tensile strength of the element wire 11 after annealing. The diameter of the element wire 11 shown in FIG. 2 is 0.21 mm. As shown in FIG. 2, for example, when tin is added to the annealed copper, as the addition amount thereof is increased, there is a tendency to increase the tensile strength of the element wire 11 after annealing. Particularly, in order to ensure a terminal fixing force of 60 N after terminal pressing, the element wire 11 after annealing preferably has a tensile strength of 300 MPa or more. For this reason, it is necessary that the concentration of tin be 0.30 wt % or more.

Figure 3:
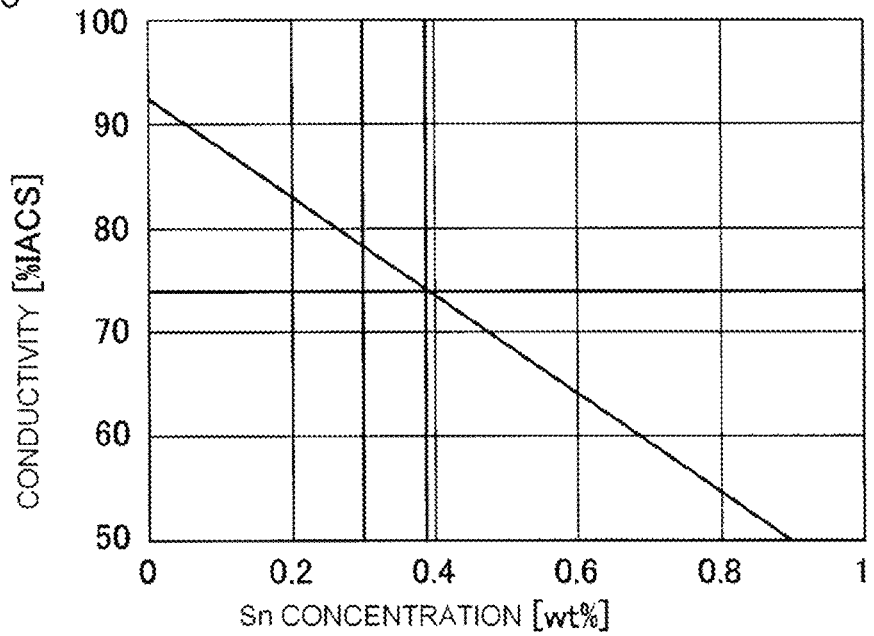
FIG. 3 is a graph showing a correlation between concentration of tin and conductivity of the element wire after annealing.

FIG. 3 is a graph showing a correlation between a concentration of tin and conductivity of the element wire 11 after annealing. As described above, when the concentration of tin is increased, there is a tendency to increase the tensile strength of the element wire 11 after annealing. However, as shown in FIG. 3, when the concentration of tin is increased, there is a tendency to decrease the conductivity of the element wire 11. Particularly, in a case where the insulated electric wire 1 is used as a product, it is necessary that the conductivity thereof be 72% IACS or more. Therefore, as shown in FIG. 3, it is necessary that the concentration of tin be 0.39 wt % or less.

From the above, in the embodiment, the element wire 11 may contain 0.30 wt % or more and 0.39 wt % or less of tin.

Furthermore, the inventors have found that when the tensile strength of the element wire 11 after annealing is not 400 MPa or less, the quality of a product is not satisfied. That is, when the tensile strength is more than 400 MPa, an extension coefficient of 10% cannot be maintained any more, and hence, the wire is poor in bending and cannot be produced as a product.

Figure 4:
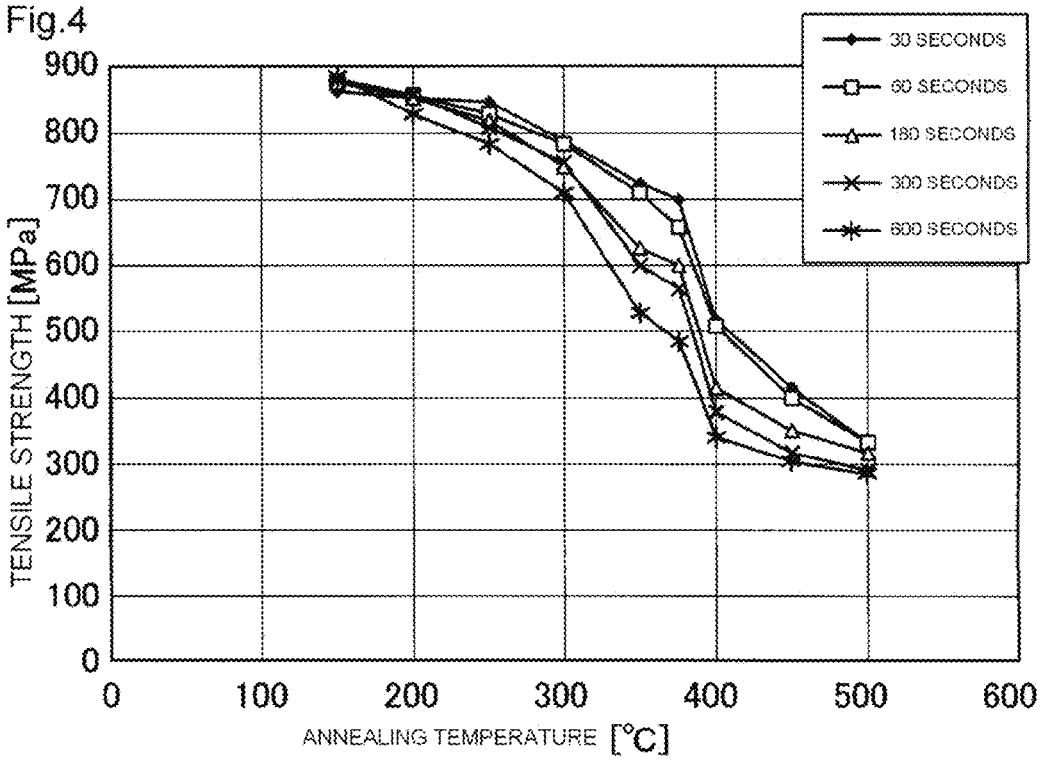
FIG. 4 is a graph showing a correlation between tensile strength and annealing temperature and annealing time in a copper alloy containing 0.30 wt % of tin.

From the above, the element wire 11 in the embodiment is annealed so that the tensile strength of the element wire 11 after annealing is 300 MPa or more and 400 MPa or less. FIG. 4 is a graph showing a correlation between tensile strength and annealing temperature and annealing time in a copper alloy containing 0.30 wt % of tin. Specifically, in order for the element wire to have a tensile strength of 300 MPa or more and 400 MPa or less, an annealing temperature and annealing time shown in FIG. 4 is necessary to be employed.

For example, when the annealing temperature is 400° C., the annealing time is 300 seconds or 600 seconds, and annealing cannot be performed during a short period of time such as 180 seconds. In addition, when the annealing temperature is 450° C., the annealing time is from 60 seconds to 600 seconds, and annealing cannot be performed during a short period of time such as 30 seconds. Furthermore, when the annealing temperature is 500° C., the annealing time is from 30 seconds to 180 seconds, and annealing cannot be performed during a long period of time such as 300 seconds or 600 seconds Next, a method for producing an insulated electric wire 1 according to the embodiment will be described. First, there is prepared a base line which is a base of the above-described element wire 11. This base line is a copper alloy containing 0.30 wt % or more and 0.39 wt % or less of tin and inevitable impurities.

Next, the base line is subjected to a wiredrawing process by a wiredrawing machine. Therefore, the element wire 11 is produced. At this time, the element wire 11 is subjected to a fine wire process to have a diameter of 0.21 mm±0.008 mm (first step).

Subsequently, the element wire 11 thus obtained is annealed. At this time, the element wire 11 is formed to have a tensile strength of 300 MPa or more and 400 MPa or less by adjusting the annealing temperature and the annealing time (second step). Accordingly, the terminal fixing force of the insulated electric wire 1 of 60 N or more is ensured and the conductivity of 72% IACS can be maintained.

In addition, it is known that there is a constant correlation between the tensile strength and the extension coefficient of the element wire 11. That is, when the tensile strength is increased, the extension coefficient is decreased, and when the tensile strength is lowered, the extension coefficient is increased. Then, in order for the element wire 11 to have a tensile strength of 300 MPa or more and 400 MPa or less, it is necessary that the extension coefficient be 10% or more and 25% or less.

Then, a twisted wire (that is, conductor 10) is produced from the element wire 11 after annealing by a strander. At this time, the seven element wires 11 are twisted with a twist pitch of 15 mm±6 mm (third step). Accordingly, the conductor 10 is obtained. The cross-sectional area of the conductor 10 is 0.2243 $mm^2$ when the element wire 11 has a diameter of 0.21 mm−0.008 mm. In addition, when the element wire 11 has a diameter of 0.21 mm+0.008 mm, the cross-sectional area of the conductor 10 is 0.2613 $mm^2$. That is, the actual cross-sectional is slightly larger than 0.22 $mm^2$. The seven element wires 11 are twisted with a twist pitch of 15 mm±6 mm, which is the standard, and thus the wire is produced to satisfy the standards in the embodiment.

Next, the conductor 10 is covered by the insulating layer 20 using an extruder. At this time, the conductor is subjected to insulation coating with a polyvinyl chloride resin composition having a smoking temperature of 170 degrees thereon with a thickness of 0.27 mm or more and 0.35 mm or less to have a finishing outer diameter of 1.2 mm (fourth step).

Figure 5:
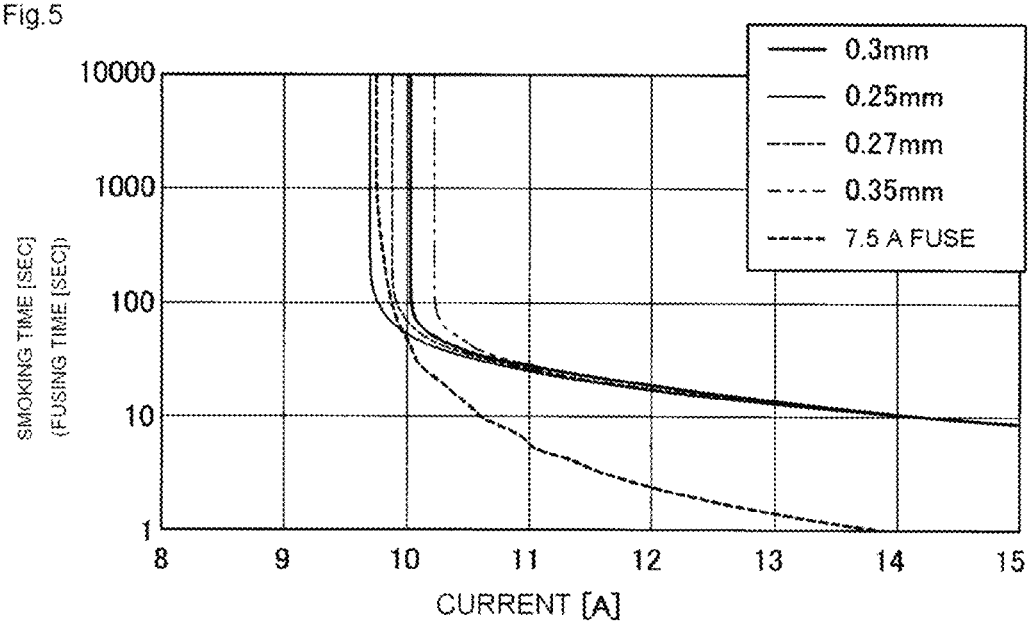
FIG. 5 is a graph showing a correlation between a current flowing in a conductor and smoking time until an insulating layer emits smoke during the flowing of the current.

FIG. 5 is a graph showing a correlation between a current flowing in the conductor 10 and smoking time until the insulating layer 20 emits smoke during the flowing of the current. In FIG. 5, together with each thickness of the insulating layer 20, a correlation between the current flowing in a 7.5 A fuse and a melting time until the fuse is melted is shown.

As shown in FIG. 5, when the thickness of the insulating layer 20 is 0.25 mm, the insulating layer 20 emits smoke in about 100 seconds in a case where a current of 9.75 A flows. Contrarily, the 7.5 A fuse is fused in about 1000 seconds in a case where a current of 9.75 A flows. For this reason, when the thickness of the insulating layer 20 is 0.25 mm, in a case where a current flows of 9.75 A, the insulating layer 20 emits smoke before the fuse is cut, and the fuse cannot works fully so that deterioration of the insulated electric wire 1 is caused. In the above description, the current of 9.75 A has been described. However, when the thickness of the insulating layer 20 is 0.25 mm, the insulating layer emits smoke before the fuse is cut with respect to an excess current of about less than 10 A.

Contrarily, when the thickness of the insulating layer 20 is 0.27 mm or more, a fuse is cut before the insulating layer emits smoke irrespective of any current. Therefore, the thickness of the insulating layer 20 is necessary to be 0.27 mm or more.

Since a polyvinyl chloride resin composition having a smoking temperature of 170 degrees is used, the thickness of the insulating layer 20 is 0.35 mm or less, and a finishing outer diameter is made 1.2 mm in the standards, the wire is produced to satisfy the standards in the embodiment.

Thus, the insulated electric wire 1 is produced. The insulated electric wire 1 can be produced with the same equipment and steps as a wire in the related art (for example, annealed copper wire), and the insulated electric wire 1 according to the embodiment can be produced without providing special equipment.

FIG. 6 is a table showing a terminal fixing force of the insulated electric wire 1 according to the embodiment. In the example shown in FIG. 6, the insulated electric wire obtained by annealing a copper alloy in which 0.3 wt % of tin is added to annealed copper to have a tensile strength of 303 MPa is shown. In addition, in FIG. 6, an annealed copper wire is also shown as a comparative example. In consideration of electrical properties, since a terminal is pressed at an area reduction rate of 10% to 40%, in the example shown in FIG. 6, results of measuring a terminal fixing force in a range of area reduction rate of 10% to 40% are shown.

As shown in FIG. 6, for example, in a case of the annealed copper wire, it was found that the terminal fixing force was 39.5 to 47.5 N immediately after a terminal A was swaged. Contrarily, in the insulated electric wire 1 according to the embodiment, it was found that the terminal fixing force was 60.5 to 76.6 N immediately after a terminal A was swaged. That is, it was found that a terminal fixing force of 60 N could be ensured.

Moreover, while the annealed copper wire had a terminal fixing force of 33.0 to 40.0 N after long time use (140 degrees×after 120 hours), it was found that the insulated electric wire 1 according to the embodiment had a terminal fixing force of 63.1 to 74.6 N.

In the same manner, it was found that the terminal fixing force of the annealed copper wire was 52.1 to 58.2 N immediately after a terminal B was swaged. Contrarily, in the insulated electric wire 1 according to the embodiment, it was found that the terminal fixing force was 67.86 to 74.70 N immediately after a terminal B was swaged. That is, it was found that a terminal fixing force of 60 N could be ensured.

Moreover, while the annealed copper wire had a terminal fixing force of 46.3 to 52.2 N after long time use (140 degrees×after 120 hours), it was found that the insulated electric wire 1 according to the embodiment had a terminal fixing force of 72.98 to 77.42 N.

Furthermore, it was found that the terminal fixing force of the annealed copper wire was 56.4 to 59.2 N immediately after a terminal C was swaged. Contrarily, in the insulated electric wire 1 according to the embodiment, it was found that the terminal fixing force was 62.1 to 73.8 N immediately after a terminal C was swaged. That is, it was found that a terminal fixing force of 60 N could be ensured.

Moreover, while the annealed copper wire had a terminal fixing force of 52.0 to 56.2 N after long time use (140 degrees×after 120 hours), it was found that the insulated electric wire 1 according to the embodiment had a terminal fixing force of 68.9 to 75.4 N.

As described above, in the method for producing an insulated electric wire 1 according to the embodiment, since the wire is refined to have a tensile strength of 300 MPa or more, a terminal fixing force of 60 N or more can be ensured. That is, when the tensile strength is less than 300 MPa, the strength of the conductor 10 is lowered and hence, in a case where the terminal is fixed, the lowering of the fixing strength thereof is caused so that a terminal fixing force of 60 N cannot be maintained. However, by refining the wire to have a tensile strength of 300 MPa or more in the second step, a terminal fixing force of 60 N or more can be ensured.

Since the wire is refined to have a tensile strength of 400 MPa or less, quality can be ensured as an insulated electric wire. That is, when the tensile strength is more than 400 MPa, an extension coefficient of 10% cannot be maintained any more. Therefore, the wire is poor in bending and cannot be produced as a product. However, by refining the wire to have a tensile strength of 400 MPa or less in the second step, an extension coefficient of 10% or more can be ensured and the quality of a product can be maintained.

The reason for using the copper alloy containing 0.30 wt % or more of tin is that when the content of tin is less than 0.30 wt %, a tensile strength of 300 MPa cannot be ensured and a terminal fixing force of 60 N cannot be maintained. Furthermore, the reason for using the copper alloy containing 0.39 wt % or less of tin is that when the content of tin is more than 0.39 wt %, conductivity is less than 72%, and a conductor resistance is more than 95 Ω/m so that the wire cannot be produced as a product.

Moreover, the polyvinyl chloride resin composition having a smoking temperature of 170 degrees is necessarily used as an insulator for a 0.22 sq wire, and has a thickness of 0.35 mm or less. In addition, when the finishing outer diameter is not 1.2 mm, the standards are not satisfied. Based on such a situation, when the thickness of the insulating layer 20 is made 0.27 mm or more, a 7.5 A fuse is cut before the insulating layer 20 emits smoke and deterioration due to the smoking of the wire itself can be prevented.

The invention has been described based on the embodiment, but the invention is not limited to the embodiment and may be modified within the range of not departing from the scope of the invention.

The present application is based on Japanese Patent Application No. 2012-125939 filed on Jun. 1, 2012, the contents of which are incorporated herein by reference.

INDUSTRIAL APPLICABILITY

According to the method for producing an insulated electric wire, a cross-sectional area of a conductor is made about 0.22 $mm^2$, and a terminal fixing force of 60 N or more can be ensured.

REFERENCE SIGNS LIST

1 Insulated electric wire
10 Conductor
11 Element wire
20 Insulating layer

The invention claimed is:

1. A method for producing an insulated electric wire, the method comprising:

a first step of processing a copper alloy containing a tin and inevitable impurities into a fine wire having a diameter of 0.21 mm±0.008 mm, the tin being 0.30 wt % or more and 0.39 wt % or less;

a second step of annealing the fine wire obtained in the first step so as to refine the fine wire to have an extension coefficient of 10% or more and 25% or less and a tensile strength of 300 MPa or more and 400 MPa or less; and a third step of twisting seven fine wires having undergone the second step with a twist pitch of 15 mm±6 mm, wherein when an annealing temperature of the second step is set as 400° C., an annealing time of the second step is between 300 seconds and 600 seconds, wherein when the annealing temperature of the second step is set as 450° C., the annealing time of the second step is between 60 seconds and 600 seconds, and wherein when the annealing temperature of the second step is set as 500° C., the annealing time of the second step is between 30 seconds and 180 seconds.

2. The method according to claim 1, further comprising:

a fourth step of making a twisted wire obtained through the third step insulation-coated with a polyvinyl chloride resin composition having a smoking temperature of 170 degrees with a thickness of 0.27 mm or more and 0.35 mm or less, making the insulated electric wire to have a finishing outer diameter of 1.2 mm.

* * * * *